United States Patent [19]

Strachan et al.

[11] 4,182,112

[45] Jan. 8, 1980

[54] CONTROL PANEL UNIT AND TIMER UNIT AND METHOD THEREFOR

[75] Inventors: Robert Strachan, Wolcott; Carl J. Goodhouse, Litchfield, both of Conn.

[73] Assignee: Robertshaw Controls Company, Richmond, Va.

[21] Appl. No.: 872,610

[22] Filed: Jan. 26, 1978

[51] Int. Cl.[2] ..... G04F 3/06

[52] U.S. Cl. ..... 58/39.5; 29/177; 58/22.9; 219/493; 236/46 D

[58] Field of Search ..... 58/22.9, 38 R, 39.5, 58/152 R, 152 B; 29/177, 179; 236/46 R, 46 D; 219/492, 493

[56] References Cited

U.S. PATENT DOCUMENTS

| | | | |
|---|---|---|---|
| 3,358,924 | 12/1967 | Goodhouse et al. | 236/46 R |
| 3,837,568 | 9/1974 | Goodhouse et al. | 219/492 X |
| 3,899,872 | 8/1975 | Flumm et al. | 58/39.5 X |
| 3,932,723 | 1/1976 | Tamano et al. | 58/39.5 X |
| 3,944,790 | 3/1976 | Tamano et al. | 219/492 X |
| 4,037,398 | 7/1977 | Flumm et al. | 58/22.9 |
| 4,104,861 | 8/1978 | Yoda et al. | 58/39.5 X |

*Primary Examiner*—Stanley J. Witkowski

*Attorney, Agent, or Firm*—Candor, Candor & Tassone

[57] ABSTRACT

A control panel unit for a cooking apparatus having a clock construction for indicating the time of day and a timer control unit for selecting a delayed time period and a cooking time period for causing the apparatus to provide a cooking operation for the cooking time period following the elapsing of the delay time period, the clock construction comprising an electronic clock unit and the timer control unit comprising an electromechanical control unit operating independently of the electronic clock unit.

20 Claims, 6 Drawing Figures

CONTROL PANEL UNIT AND TIMER UNIT AND METHOD THEREFOR

BACKGROUND OF THE INVENTION

1. Field of the Invention

This invention relates to an improved control panel unit for a cooking apparatus or the like and to a method of making such a control panel unit or the like as well as to an improved timer unit for such a control panel unit or the like.

2. Prior Art Statement

It is known to applicants to have a control panel unit for a rotisserie cooking apparatus wherein the panel unit has a timer control means for selecting a delay time period and a cooking time period for causing the apparatus to provide a rotisserie cooking operation for the cooking time period following the elapsing of the delay time period, no time of day clock means being provided with such electromechanical timer control means.

It is also known to applicants to provide a control panel unit for a cooking apparatus or the like having an electrical clock construction for indicating the time of day and a timer control means for selecting a delay time period and a cooking time period for causing the apparatus to provide a cooking operation for the cooking time period following the elapsing of the delay time period, the electrical clock construction being a conventional electromechanical mechanism and providing the drive means for the timer control means.

For example, see the following item:

(1) U.S. Pat. No. 3,358,924 — Goodhouse, et al.

It appears that the control panel unit of Item (1) above has a timer motor for driving the time of day clock mechanism as well as for providing the drive means for the timer means that is adapted to select a delay time period and a cooking time period for causing a cooking apparatus to provide a cooking operation for the cooking time period following the elapsing of the delay time period whereby the clock mechanism and timer control mechanism are interrelated and are electromechanical.

The timer control unit of Item (1) above appears to have a first selector means for selecting a delay time period and a second selector means for selecting a cooking time period with the unit having a drive motor that is adapted to have a drive gear thereof operatively interconnected to a driven gear of the second selector means by the first selector means to operate the second selector means during the cooking time period after the elapsing of the delay time period, the first selector means comprising an axially movable shaft carrying a single gear-like member thereon that is adapted to operatively interconnect the drive gear with the driven gear following the elapsing of the delay time period.

SUMMARY OF THE INVENTION

It was found according to the teachings of this invention that while the state of the art in clock constructions for indicating time of day is rapidly progressing into electronic clock constructions wherein liquid crystal time indicating means is electronically operated, the timer control units for cooking apparatus and the like have normally been electromechanical units that have been driven by the timer motors of the conventional electromechanical clock constructions to provide accurate and reliable control means for the cooking apparatus.

Therefore, it is a feature of this invention to provide a control unit that will combine the new electronic clock construction with a proven electromechanical timer control means for the cooking apparatus.

In particular, one embodiment of this invention provides a control panel unit for a cooking apparatus or the like and having a clock construction for indicating the time of day and a timer control means for selecting a delay time period and a cooking time period for causing the apparatus to provide a cooking operation for the cooking time period following the elapsing of the delay time period, the clock construction comprising an electronic clock means and the timer control means comprising electromechanical means operating independently of the electronic clock means.

In this manner, the uncertainties of the electronic clock means are not projected into the proven reliability of an electromechanical timer control means.

In order to provide the above improved control panel unit, it was found according to the teachings of this invention, that the timer control unit can be improved by changing the conventional selector means for the delay time period of the control unit.

In particular, an embodiment of the timer unit of this invention comprises a first selector means for selecting a delay time period and a second selector means for selecting a cooking time period that will cause the apparatus to provide a cooking operation for the cooking time period following the elapsing of the delay time period. The timer unit has a drive motor that is adapted to have a drive gear thereof operatively interconnected to a driven gear of the second selector means by the first selector means to operate the second selector means during the cooking time period after the elapsing of the delay time period. The first selector means comprises an axially movable shaft carrying a pair of gear-like members that are axially movable therewith, one of the gear-like members being adapted to operatively interconnect the drive gear with the driven gear following the elapsing of the delay time period.

Accordingly, it is an object of this invention to provide an improved control panel unit for a cooking apparatus or the like, the control panel unit of this invention having one or more of the novel features of this invention as set forth above or hereinafter shown or described.

Another object of this invention is to provide a method of making such a control panel unit, the method of this invention having one or more of the novel features of this invention as set forth above or hereinafter shown or described.

Another object of this invention is to provide an improved timer unit for a cooking apparatus or the like, the timer unit of this invention having one or more of the novel features of this invention as set forth above or hereinafter shown or described.

Other objects, uses and advantages of this invention are apparent from a reading of this description which proceeds with reference to the accompanying drawings forming a pair thereof and wherein:

DESCRIPTION OF THE PREFERRED EMBODIMENT

Figure 1:
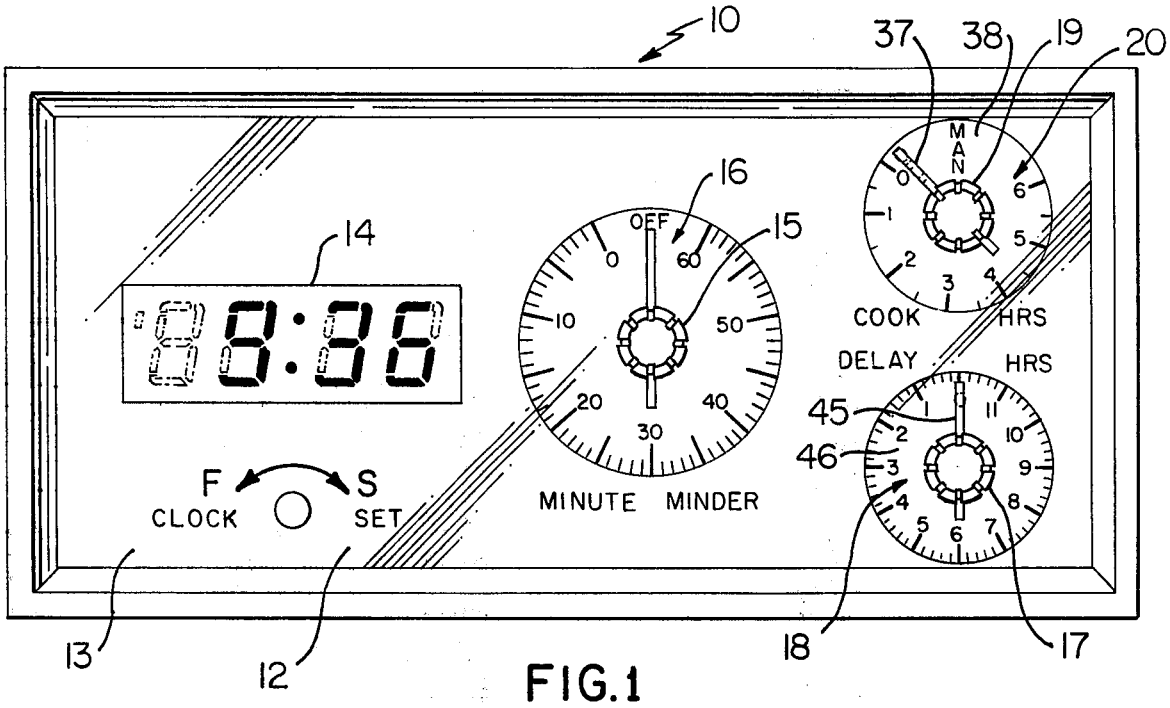
FIG. 1 is a front view of the improved control panel unit of this invention.

While the various features of this invention are hereinafter illustrated and described as being particularly adapted to provide control means for a cooking apparatus, it is to be understood that the various features of this invention can be utilized singly or in any combination thereof to provide control means for other devices as desired.

Therefore, this invention is not to be limited to only the embodiment illustrated in the drawings, because the drawings are merely utilized to illustrate one of the wide variety of uses of this invention.

Figure 2:
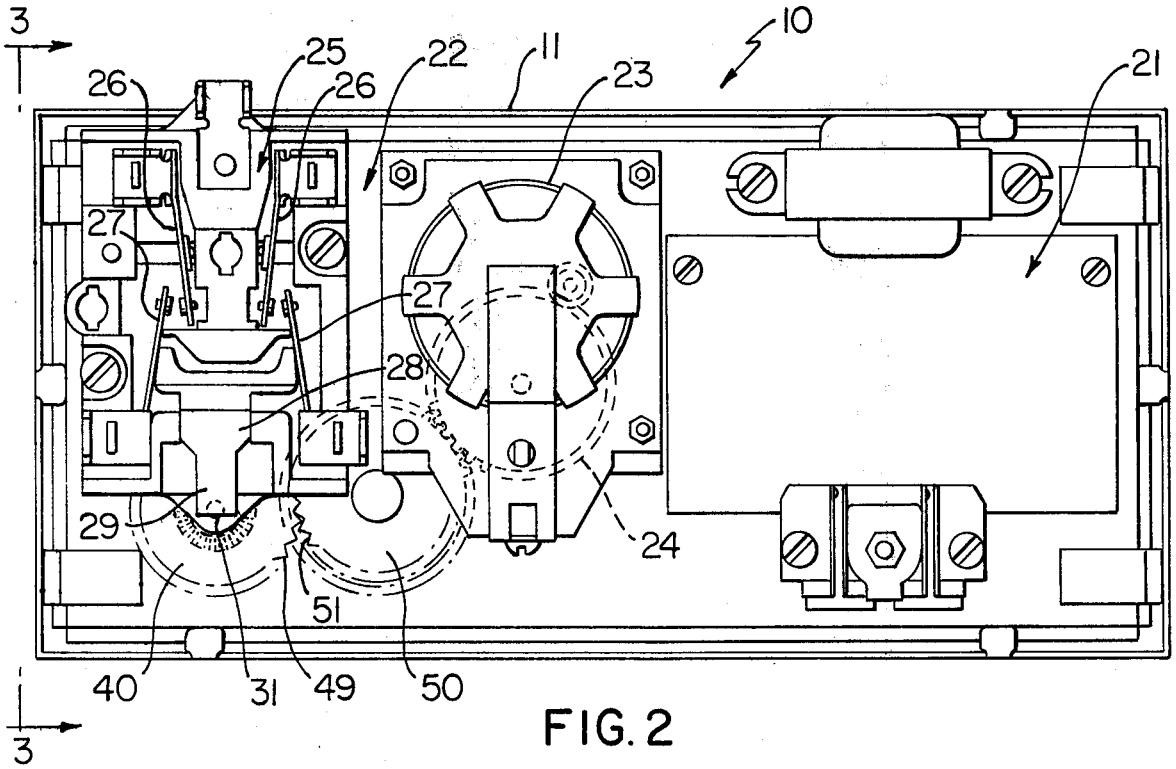
FIG. 2 is a rear view of the control panel unit of FIG. 1.

Referring now to FIGS. 1 and 2, the improved control panel unit of this invention is generally indicated by the reference numeral 10 and comprises a frame means 11 having a front control panel 12 covered by a glass or plastic sheet 13 in a conventional manner to expose a time of day indicating means 14, a selector means 15 for an interval timer means 16, a selector means 17 for a delay time period means 18 and a selector means 19 for a cooking time period means 20, the grasping portions of the selector means 15, 17 and 19 projecting through suitable openings in the cover sheet 13 in a conventional manner.

As illustrated in FIG. 2, the time of day indicating means 14 is controlled by an electronic clock means that is generally indicated by the reference numeral 21 and the details thereof do not form any part of this invention as the electronic clock means 21 can comprise any conventional means for electronically operating the time of day indicating means 14, such as a liquid crystal indicating means, that are well known in the art.

However, it is a feature of this invention to combine such conventional electronic clock means 21 in the same control panel unit 10 as the electromechanical timer means of this invention that is generally indicated by the reference numeral 22 in FIG. 2 and is utilized for controlling the cooking operation of a cooking apparatus or the like through the use of the selector means 17 and 19 thereof in a manner hereinafter described.

The electromechanical timer means 22 of this invention includes an electrical timer motor 23 that operates independently of the electronic clock means 21 and is adapted to continuously rotate an output gear 24 that is rotatably mounted to the frame means 11 in any suitable manner.

Figure 4:
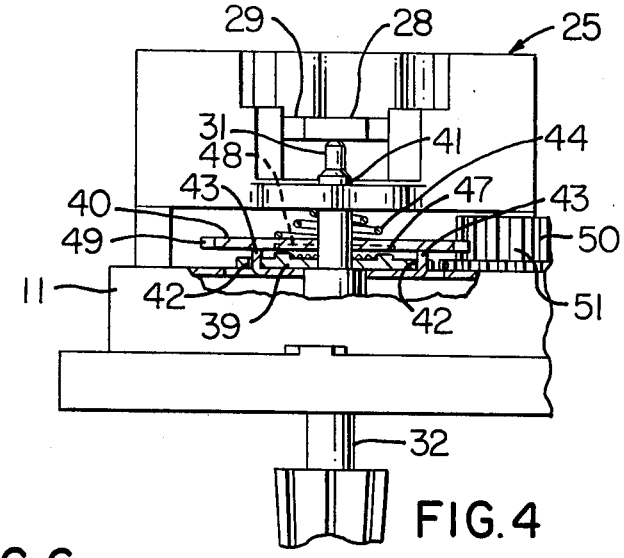
FIG. 4 is a fragmentary, partially broken away and cross-sectioned view of the control panel unit of FIG. 3 and is taken in the direction of the arrows 4—4 thereof.

The electromechanical timer means 22 also includes a switch construction that is generally indicated by the reference numeral 25 and is of the type fully disclosed in the aforementioned U.S. Pat. No. 3,358,924, to Goodhouse et al., whereby the details thereof need not be fully described other than to state that the same incudes a first pair of electrical switch blades 26 that are adapted to be set in an operating condition thereof by the selector means 19 in a manner hereinafter described and a second pair of electrical switch blades 27 that are adapted to cooperate with the set switch blades 26 whenever a pivotable actuator 28 has its end 29 in the down position as illustrated in FIG. 4. However, when the actuator 28 has it end 29 held upwardly in the manner illustrated in FIGS. 3 and 5, the switch blades 27 are held out of operative engagement with the set switch blades 26 so that the switch construction 25 cannot operate the cooking apparatus associated therewith as fully described in the aforementioned U.S. Pat. No. 3,358,924 to Goodhouse et al.

Figure 3:
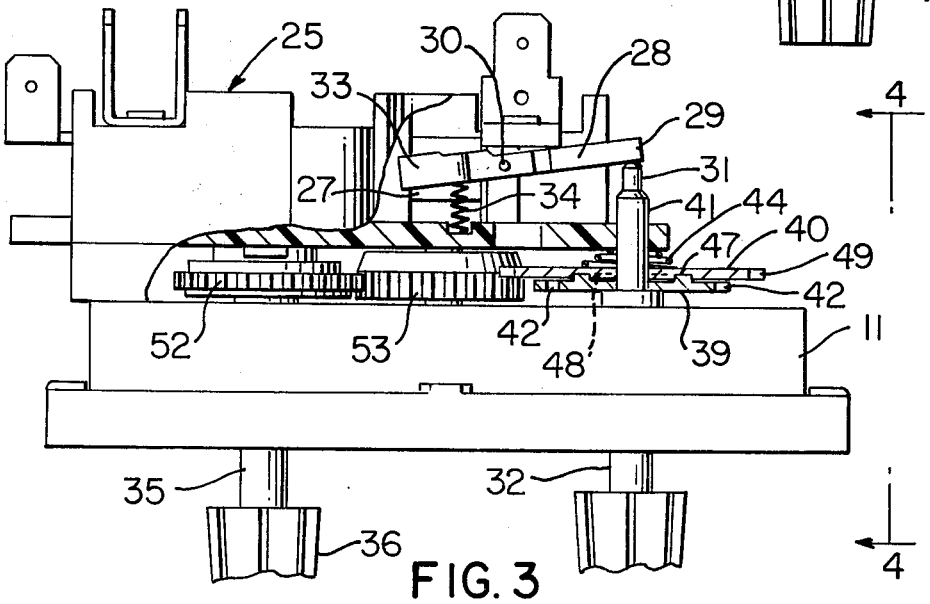
FIG. 3 is an end view of the control panel unit of FIGS. 1 and 2 and is taken in the direction of the arrows 3—3 of FIG. 2.

As illustrated in FIG. 3, the actuator 28 is pivotally mounted to the frame means 11 by pivot means 30 with the end 29 thereof being engageable by an end 31 of an axially and rotatably movable shaft 32 of the selector means 17 that is operated in a manner hereinafter described, the other end 33 of the actuator 28 being adapted to act on the switch blades 27 and normally being urged n a clockwise direction by a compression spring 34 as illustrated in FIG. 3.

The selector means 19 also includes a rotatable shaft 35 carried by the frame means 11 and when the shaft 35 is rotated by an operator grasping a control knob 36 disposed thereon to move an indicator 37, FIG. 1, of the shaft 35 relative to a dial face 38 on the control panel 12, the switch blades 26 will remain in the "out" condition for the amount of time that is set by the indicator 37 thereof once the selector means 19 becomes operable upon the termination of the delay time period set by the selector means 17 in a manner hereinafter described.

Figure 6:
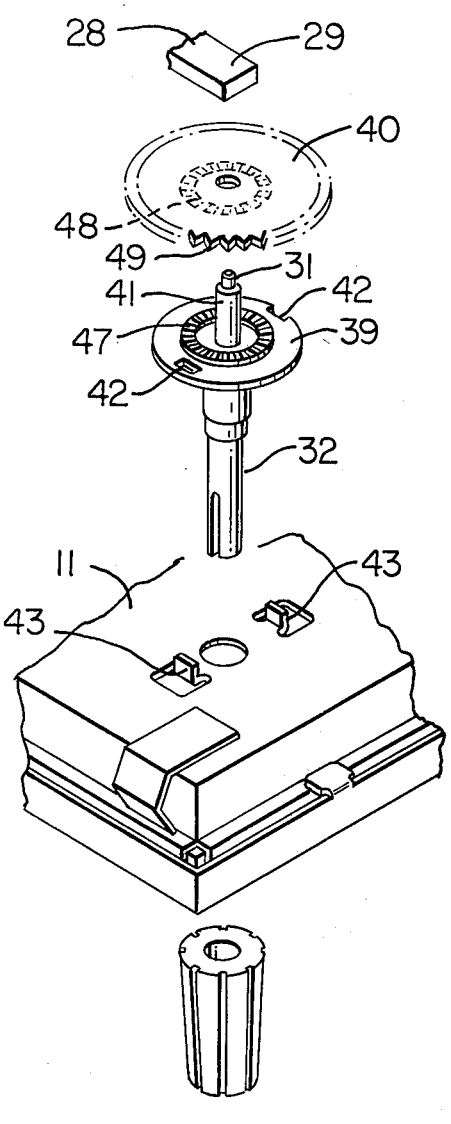
FIG. 6 is an exploded fragmentary perspective view of the delay time period selector means of this invention.
Figure 5:
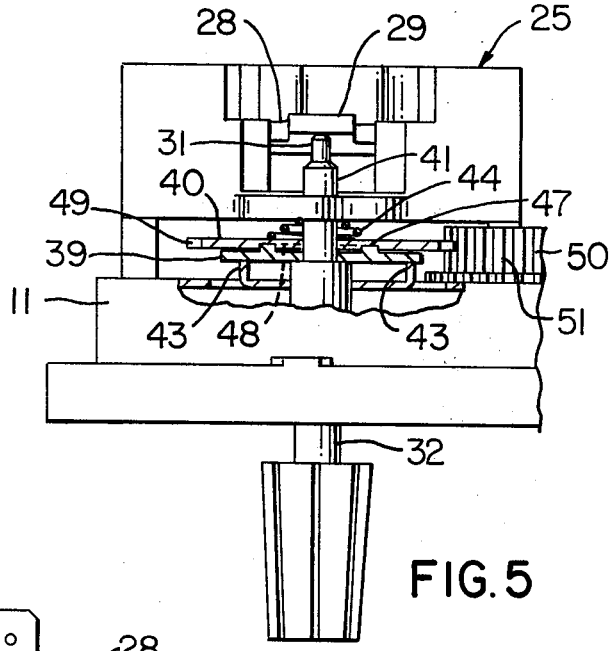
FIG. 5 is a view similar to FIG. 4 and illustrates the time delay selector means set for a selected time delay period.

As illustrated in FIGS. 4–6, the selector shaft 32 of the selector means 17 carries a pair of gear-like members 39 and 40, the gear-like member 39 being fixed to the shaf 32 so as to rotate and axially move in unison therewith whereas the gear 40 is loosely telescoped onto a reduced portion 41 of the shaft 32 so as to permit the same to move axially and rotate relative to the shaft 32 as will be apparent hereinafter.

The fixed gear-like member 39 has a pair of slot means or cutouts 42 formed therethrough, as best illustrated in FIG. 6, which are adapted to register with outwardly turned abutments or prongs 43 on the frame 11 to permit the shaft 32 to be moved out to its out axial position as illustrated in FIG. 4 under the force of a compression spring 44 disposed between the frame 11 and the gear-like member 40.

The cutouts 42 of the gear-like member 39 are only disposed in registry with the abutments 43 of the frame 11 when the control shaft 32 is set in the rotational position thereof where an indicator 45, FIG. 1, of the shaft 32 is set at the zero position on a dial face 46 of the control panel 12 to indicate that no delay hours has been set by the selector means 17.

With the shaft 32 in its outermost axial position as illustrated in FIG. 4, the end 29 of the actuator 28 is in such a pivoted position that the switch blades 27 are in their innermost position so that if the selector means 19 of the cook hours is set in its manual or any time indicating position thereof, the shaft 35 has moved the switch blades 26 outwardly so as to be placed in electrical contact with the switch blades 27 to permit the cooking apparatus to perform a cooking operation as long as the blades 26 are in their out position and the blades 27 are in their in position for the reasons fully set forth in the aforementioned U.S. Pat. No. 3,358,924 to Goodhouse et al.

Thus, whenever the selector means 19 is set for a certain amount of cook hours, the switch blades 26 are held outwardly until the time period set for by the selector means 19 has elapsed whereby when the shaft 35 has moved the indicator 37 thereof to the zero position as illustrated in FIG. 1 at the termination of the selected cooking time period, the switch blades 26 are moved inwardly to the position illustrated in FIG. 2 so that the switch blades 27 cannot cooperate therewith regardless of whether the selector means 17 is set for a delay period or is at the zero position as illustrated in FIG. 1.

However, when the selector shaft 32 of the selector means 17 is pushed axially inwardly by the operator in opposition to the force of the compression spring 44, the gear-like member 39 is moved axially inwardly therewith to clear the slot means 42 from the prongs 43 of the frame 11 so that the shaft 32 can be rotated to set the indicator 45 thereof to the desired period of delay time that the timer means 22 is to provide before a cooking operation, such rotation of the shaft 32 likewise causing the gear-like member 39 to rotate so that the slot means 42 thereof are out of register with the prongs 43 and the prongs 43 will hold the shaft 32 and gear-like member 39 inwardly as illustrated in FIG. 5 in opposition to the force of the compression spring 44. Thus, the gear-like member 39 must be rotated back to the position thereof where the slot means 42 will register with the prongs 43 to permit the shaft 32 to move axially outwardly as illustrated in FIG. 4 only upon the termination of the selected time delay period as will be apparent hereinafter.

The gear-like member 39 has a circular array of gear teeth 47 on a face thereof, as best illustrated in FIG. 6, that is adapted to cooperate with a circular array of gear teeth 48 on the facing side of the gear-like member 40 so as to drivingly interconnect the gear-like members 40 and 39 together. However, the gear teeth 47 and 48 on the gear-like members 39 and 40 permit the same to ratchet relative to each other in a clutching manner as will be apparent hereinafter.

The gear-like member 40 also has a plurality of gear-like teeth 49 on the outer periphery thereof that are always disposed in meshing relation with a drive gear 50 that is rotatably mounted to the frame means 11 and is disposed in meshing relation with the output gear 24 of the timer motor 23.

In this manner, as long as the timer motor 23 is operating, the gear-like member 40 is always being rotated by the drive gear 50 since the drive gear 50 has relatively wide teeth 51 on the outer periphery thereof as illustrated in FIGS. 4 and 5 in a manner to always drive the gear-like member 40 regardless of the axial position of the gear-like member 40 relative to the drive gear 50.

The switch construction 25 includes a pair of gears 52 and 53 disposed in meshing relation with each other for rotating the shaft 35 back to the off position illustrated in FIG. 1 whenever the shaft 35 has been set for a cooking hours position thereof and the gear-like member 40 of the selector means 17 will only be disposed in meshing relation with the gear 53 when the shaft 32 is disposed in its outermost axial condition as illustrated in FIG. 4 whereby the gear-like member 40 will operatively interconnect the drive gear 50 with the driven gear 53 of the switch means 25. However, when the shaft 32 is moved axially inwardly and is held axially inwardly by the projections 43 of the frame 11 as illustrated in FIGS. 3 and 5, the gear teeth 49 of the gear-like member 40 are disposed out of mesh with the gear 53 so that the gear 40 will rotate relative to the gear 53 by the drive gear 50 for a purpose hereinafter described.

Therefore, it can be seen that the selector means 17 for the delay means 18 of the timer means 22 comprises a selector shaft 32 carrying a pair of gear-like members 39 and 40 that permit the control panel means 10 and timer means 22 of this invention to operate in a manner now to be described.

When the control panel unit 10 of this invention is being utilized as the timer means for a cooking apparatus, the electronic clock means 21 continuously indicates through the liquid crystal indicator 14 the time of day in a manner well known for electronic clock operations.

Also, the timer motor 23 is continuously running so as to continuously drive the meshing gear means 24, 50 and gear-like member 40 of the selector means 17.

With the selector means 17 and means 19 set in the zero positions illustrated in FIG. 1, the selector shaft 32 of the selector means 17 is in its completely out axial position as illustrated in FIG. 4 whereby the gear-like member 40 is continuously rotating and will not drive the gear-like member 39 therewith as the gear-like member 40 is held away from the gear-like member 39 by the projections 43 of the frame 11 so that the face gear 48 of the gear-like member 40 is out of mesh with the face gear 47 of the gear-like member 39. In this manner, the shaft 32 does not rotate with the rotation of the gear-like member 40 and the same remains in its zero position, the out zero condition of the shaft 32 holding the switch actuator 28 in a position that permits the switch blades 27 to be in their "in" condition.

The rotation of the gear-like member 40 causes like rotation of the gears 53, 52 but since the shaft 35 of the selector means 19 is in the zero position thereof, the shaft 35 remains in its zero position and the switch blades 26 of the switch construction 25 remain in the "in" position illustrated in FIG. 2, so that even though the switch blades 27 are in their "in" position, the switch blades 27 are not in electrical contact with the switch blades 26 so that the cooking apparatus cannot be operated by the timer means 22 of the invention.

However, if the housewife or the like desires to utilize the cooking apparatus for a manual operation thereof, the selector means 17 remains in the "zero" position illustrated in FIG. 1 and the selector means 19 is rotated to the "MAN" position thereof whereby the control shaft 35 causes the switch blades 26 to be moved outwardly and be held in the outward position thereof against the "in" switch blades 27 so as to permit the cooking apparatus to be operated in a conventional manner as long as the selector means remains in the "MAN" position thereof.

When the housewife or the like desires to utilize the control panel unit 10 to provide a delayed cooking operation, the housewife or the like pushes axially inwardly on the control shaft 32 of the selector means 17 until the gear member 39 clears the abutments 43 of the frame 11 as illustrated in FIG. 5 and then rotates the shaft 32 to the desired delay time period, such as two hours, if for example the time of day clock indicator 14 is indicating 12:00 o'clock and the housewife knows that the particular item she is going to cook must cook for four hours and be ready at 6:00.

Thus, it can be seen that the housewife or the like makes a mental calculation by looking at the time of day indicator 14 and by knowing that she wants the item to cook four hours and be ready by 6:00, then she must set the delay time period selector means 17 for a two hour delay so that cooking operation will not begin until 2:00 and will be completed at 6:00.

With the selector shaft 32 now set at the two hour delay period thereof, it can be seen that the slot means 42 of the gear-like member 39 are disposed out of registry with the abutments 43 so the gear-like members 39 and 40 are disposed against the abutments 43 in stacked relation as illustrated in FIG. 5 by the spring 44 and will rotate in unison as the drive gear 50 rotates the gear-like member 40 and the face gears 48 and 47 of the gear-like members 40 and 39 are in mesh with each other. Thus, the gear-like member 39 rotates in unison with the gear-like member 40 and will have the slot means 42 thereof rotated back into registry with the abutments 43 of the frame 11 only when the selected two hour delay period has elapsed.

However, with the gear-like member 40 being held in its "in" axial position as illustrated in FIG. 3, the gear-like member 40 is out of mesh with the gear 53 so that gear 53 will not drive the control shaft 35 and this "in" position of the selector shaft 32 causes the actuator 28 to hold the switch blades 27 in the "out" condition.

As previously stated, the housewife wants the cooking hour period to be four hours so that the control shaft 35 of the selector means 19 is rotated so that the indicator 37 thereof will be set at the four hour position thereof, such rotation of the shaft 35 causing the switch blade members 26 to be moved and held outwardly. However, as previously described, the "in" position of the selector shaft 32 of the selector means 17 has pivoted the actuator 28 to the position illustrated in FIG. 3 to hold the switch blades 27 in their "out" condition whereby the switch blades 27 are held out of contact with the "out" switch blades 26 so that a cooking operation cannot take place during the running of the delay time period.

Thus, for the next two hours, the gear-like members 39 and 40 are being rotated in a direction by the drive gear 50 so that at the end of the two hour delay period, the slot means 42 of the gear-like member 39 are disposed in registry with the projections 43 of the frame means 11 to permit the gear-like member 39 to be moved downwardly with the shaft 32 from the position illustrated in FIG. 5 to the position illustrated in FIG. 4 under the force of the compression spring 44 to not only disengage the gear-like member 39 from the gear-like member 40 for the reasons previously set forth, but to also cause the actuator 28 to move in a clockwise direction in FIG. 3 and permit the switch blades 27 to move in and into electrical contact with the "out" switch blades 26 so that the cooking apparatus will now be placed in a cooking condition thereof, which, in this example, begins at 2:00 o'clock and will continue until 6:00 o'clock.

The axially outwardly moved gear-like member 40 is now disposed in meshing relation with the gear 53 so as to interconnect the drive gear 50 therewith whereby the gears 53 and 52 begin to rotate the shaft 35 from the "four hour" setting thereof back to the "zero" hour setting thereof which will take four hours and during that time, the switch construction 25 is permitting the cooking apparatus to be operated in the manner fully set forth in the aforementioned U.S. Pat. No. 3,588,924 to Goodhouse et al. When the shaft 35 of the selector means 19 reaches the "zero" setting thereof as illustrated in FIG. 1, the shaft 35 causes the switch blades 26 to move inwardly away from the "in" switch blades 27 to terminate the cooking operation of the cooking apparatus and the selector means 17 and 19 will remain in the zero conditions thereof as illustrated in FIG. 1 until it is desired to utilize the timer means 22 for another delayed cooking operation thereof or for a manual operation as previously described.

If desired, the timer motor 23 can also be utilized in connection with the selector means 15 to provide an interval timer means in a manner well known in the art.

Therefore, it can be seen that this invention not only provides an improved control panel unit and method of making the same, but also this invention provides an improved timer unit for use with such a control panel unit or the like.

While the form and method of this invention now preferred have been illustrated and described as required by the Patent Statute, it is to be understood that other forms and method steps can be utilized and still fall within the scope of the appended claims.

What is claimed is:

1. In a control panel unit for a cooking apparatus or the like and having a clock construction for indicating the time of day and a timer control means for selecting a delay time period and a cooking time period for causing said apparatus to provide a cooking operation for said cooking time period following the elapsing of said delay time period, the improvement wherein said clock construction comprises an electronic clock means and said timer control means comprises electromechanical means operating independently of said electronic clock means.

2. A control panel unit as set forth in claim 1 wherein said timer means includes a continuously running electrical motor having an output drive means.

3. A control panel unit as set forth in claim 2 and including an interval timer carried by said unit and being operatively associated with said motor to be driven thereby.

4. A control panel unit as set forth in claim 2 wherein said timer means includes a first selector means in said unit for selecting said delay time period and a second selector means for selecting said cooking time period.

5. A control panel unit as set forth in claim 4 wherein said timer means includes driven means adapted to be operatively interconnected to said drive means of said motor when said selected delay time period has elapsed to cause said cooking operation during the elapsing of said cooking time period.

6. In a method of making a control panel unit for a cooking apparatus or the like and having a clock construction for indicating the time of day and a timer control means for selecting a delay time period and a cooking time period for causing said apparatus to provide a cooking operation for said cooking time period following the elapsing of said delay time period, the improvement comprising the steps of forming said clock construction from an electronic clock means, and forming said timer control means from electromechanical means that operate independently of said electronic clock means.

7. A method of making a control panel unit as set forth in claim 6 and including the step of forming said timer means with a continuously running electrical motor having an output drive means.

8. A method of making a control panel unit as set forth in claim 7 and including the step of providing an interval timer to be carried by said unit and be operatively associated with said motor to be driven thereby.

9. A method of making a control panel unit as set forth in claim 7 and including the step of forming said timer means to include a first selector means on said unit for selecting said delay time period and a second selector means for selecting said cooking time period.

10. A method of making a control panel unit as set forth in claim 9 and including the step of forming said timer means to include driven means adapted to be operatively interconnected to said drive means of said motor when said selected delay time period has elapsed to cause said cooking operation during the elapsing of said cooking time period.

11. In a timer unit for a cooking apparatus and having a first selector means for selecting a delay time period and a second selector means for selecting a cooking time period that will cause said apparatus to provide a cooking operation for said cooking time period following the elapsing of said delay time period, said second selector means having a driven gear that operates said second selector means when said driven gear is driven, said unit having a drive gear, said unit having a drive motor operatively interconnected to said drive gear to drive said drive gear, said first selector means being adapted to operatively interconnect said drive gear to said driven gear to operate said second selector means during said cooking time period after the elapsing of said delay time period, the improvement wherein said first selector means comprises an axially movable shaft carrying a pair of gear-like members that are axially movable therewith, one of said gear-like members being adapted to operatively interconnect said drive gear with said driven gear following the elapsing of said delay time period.

12. A timer unit as set forth in claim 11 wherein said unit has a frame, said gear-like members being rotatable relative to said frame.

13. A timer unit as set forth in claim 12 wherein said one gear-like member is always disposed in mesh with said drive gear regardless of its axial position relative to said frame.

14. A timer unit as set forth in claim 13 wherein said one gear-like member is only disposed in mesh with said driven gear when said one gear-like member is in one axial position relative to said frame.

15. A timer unit as set forth in claim 14 wherein said gear-like members have clutching means adapted to cooperate together to cause said gear-like members to rotate together relative to said frame under certain conditions.

16. A timer unit as set forth in claim 15 wherein said frame has abutment means adapted to hold said gear-like members in a certain axial position thereof when said gear-like members have been axially moved to said certain axial position thereof and the other of said gear-like members has been rotated by said shaft out of one rotational position thereof relative to said frame.

17. A timer unit as set forth in claim 16 wherein said other gear-like member has opening means adapted to register with said abutment means to cause said gear-like members to move from said certain axial position thereof to said one axial position where said one gear-like member is disposed in mesh with said driven gear.

18. A timer unit as set forth in claim 17 wherein spring means is carried by said frame and is operatively interconnected to said gear-like members to tend to axially move said gear-like members to said one axial position thereof.

19. A timer unit as set forth in claim 18 wherein said spring means comprises a compression spring telescopically disposed on said shaft.

20. A timer unit as set forth in claim 19 wherein said one gear-like member is adapted to rotate relative to said shaft, said other gear-like member being fixed to said shaft so as to rotate and axially move in unison therewith.

* * * * *